US008260176B2

(12) United States Patent
Nozawa et al.

(10) Patent No.: US 8,260,176 B2
(45) Date of Patent: Sep. 4, 2012

(54) DEVELOPER STORING CONTAINER INCLUDING AN AGITATION MEMBER FOR AGITATING DEVELOPER, DEVELOPING DEVICE INCLUDING THE DEVELOPER STORING CONTAINER AND IMAGE FORMING APPARATUS INCLUDING THE DEVELOPER STORING CONTAINER

(75) Inventors: Ken Nozawa, Tokyo (JP); Yukiyoshi Oda, Tokyo (JP); Atsushi Ohta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 328 days.

(21) Appl. No.: 12/656,298

(22) Filed: Jan. 25, 2010

(65) Prior Publication Data

US 2010/0189469 A1 Jul. 29, 2010

(30) Foreign Application Priority Data

Jan. 26, 2009 (JP) ..... 2009-014741

(51) Int. Cl.
*G03G 15/08* (2006.01)

(52) U.S. Cl. ..... 399/254; 399/263

(58) Field of Classification Search ..... 399/254, 399/263

See application file for complete search history.

(56) References Cited

U.S. PATENT DOCUMENTS 5,568,237 A 10/1996 Ishida et al.
6,526,245 B1 * 2/2003 Yamashita ..... 399/254
7,742,726 B2 * 6/2010 Mase et al. ..... 399/263
2007/0048024 A1 3/2007 Choi et al.
2007/0196135 A1 * 8/2007 Fukuta ..... 399/254
2009/0087226 A1 * 4/2009 Yamazaki et al. ..... 399/263

FOREIGN PATENT DOCUMENTS

JP 2005-017478 A 1/2005
JP 2005-351969 12/2005
JP 2006-284776 10/2006
JP 2008-111900 5/2008
JP 2008-134521 A 6/2008

* cited by examiner

*Primary Examiner* — David Gray
*Assistant Examiner* — G. M. Hyder
(74) *Attorney, Agent, or Firm* — Rabin & Berdo, P.C.

(57) ABSTRACT

A developer storing container includes a developer storing portion having a developer outlet opening at a substantially longitudinal center portion, and an agitation member rotatable about a rotation axis to thereby agitate and eject the developer via the developer outlet opening. The agitation member includes a mounting portion with a mounting surface along the rotation axis, and an elongated flexible member having first and second ends. The flexible member is mounted to the mounting portion at the first end so that the second end defines a sliding end portion at which the flexible member slides in a sliding direction. Both longitudinal end portions of the sliding end portion of the flexible member slide along the inner surface of the developer storing container, ahead of a substantially longitudinal center portion of the sliding end portion in the sliding direction, and are inclined with respect to a direction perpendicular to the sliding direction.

13 Claims, 13 Drawing Sheets

DEVELOPER STORING CONTAINER INCLUDING AN AGITATION MEMBER FOR AGITATING DEVELOPER, DEVELOPING DEVICE INCLUDING THE DEVELOPER STORING CONTAINER AND IMAGE FORMING APPARATUS INCLUDING THE DEVELOPER STORING CONTAINER

BACKGROUND OF THE INVENTION

The present invention relates to an image forming apparatus using an electrophotographic technique such as a printer, a facsimile machine or the like.

Conventionally, an image forming apparatus is used as a printer, a copier, a facsimile machine, a combined machine or the like. Such an image forming apparatus includes a photosensitive drum on which a latent image is formed, and a developing device that develops the latent image using a toner (i.e., a developer) to form a toner image. A toner cartridge is detachably attached to the developing device, and stores the toner to be supplied to the developing device.

The toner cartridge includes a toner storing portion in which a fresh toner is stored. The toner storing portion has a toner outlet opening through which the toner is supplied to the developing device. The toner outlet opening is formed on a longitudinal center portion of the toner cartridge, as disclosed in Japanese Laid-Open Patent Publication No. 2005-17478.

Recently, it is demanded to enhance efficiency in the use of the toner.

SUMMARY OF THE INVENTION

The present invention is intended to provide a developer storing container, a developing device and an image forming apparatus capable of reducing an amount of unusable developer to thereby enhance efficiency in the use of developer.

The present invention provides a developer storing container including a developer storing portion with an elongated shape for storing a developer and having a developer outlet opening at a substantially longitudinal center portion of the developer storing portion, and an agitation member that rotates about a rotation axis to agitate the developer in the developer storing portion so as to eject the developer via the developer outlet opening. The agitation member includes a mounting portion with a mounting surface along the rotation axis, and an elongated flexible member having first and second ends facing each other. The flexible member is mounted to the mounting portion at the first end so that the second end defines a sliding end portion at which the flexible member slides along an inner surface of the developer storing portion in a sliding direction. Both longitudinal end portions of the sliding end portion slide along the inner surface of the developer storing portion, ahead of a substantially longitudinal center portion of the sliding end portion in the sliding direction, and are inclined with respect to a direction perpendicular to the sliding direction.

With such a configuration, the developer in the developer storing portion is efficiently conveyed to the developer outlet opening. Therefore, the amount of unusable developer in the developer storing portion can be reduced, and a sufficient amount of developer can be used for printing as desired.

The present invention also provides a developer storing container including a developer storing portion with an elongated shape for storing a developer and having a developer outlet opening at a substantially longitudinal center portion of the developer storing portion, and an agitation member disposed along a longitudinal direction of the developer storing portion. The agitation member rotates about a rotation axis to agitate the developer in the developer storing portion so as to eject the developer via the developer outlet opening. The agitation member includes a mounting portion with a mounting surface having an arcuate shape which is shaped so that a distance from the rotation axis to the mounting surface increases toward either longitudinal end portion of the mounting portion, and a flexible member having a substantially elongated rectangular shape and having first and second ends facing each other. The flexible member is mounted to the mounting portion at the first end so that the second end defines a sliding end portion at which the flexible member slides along an inner surface of the developer storing portion.

The present invention also provides a developing device including the above described developer storing container.

The present invention also provides an image forming apparatus including the above described developing device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

First Embodiment

Figure 1:
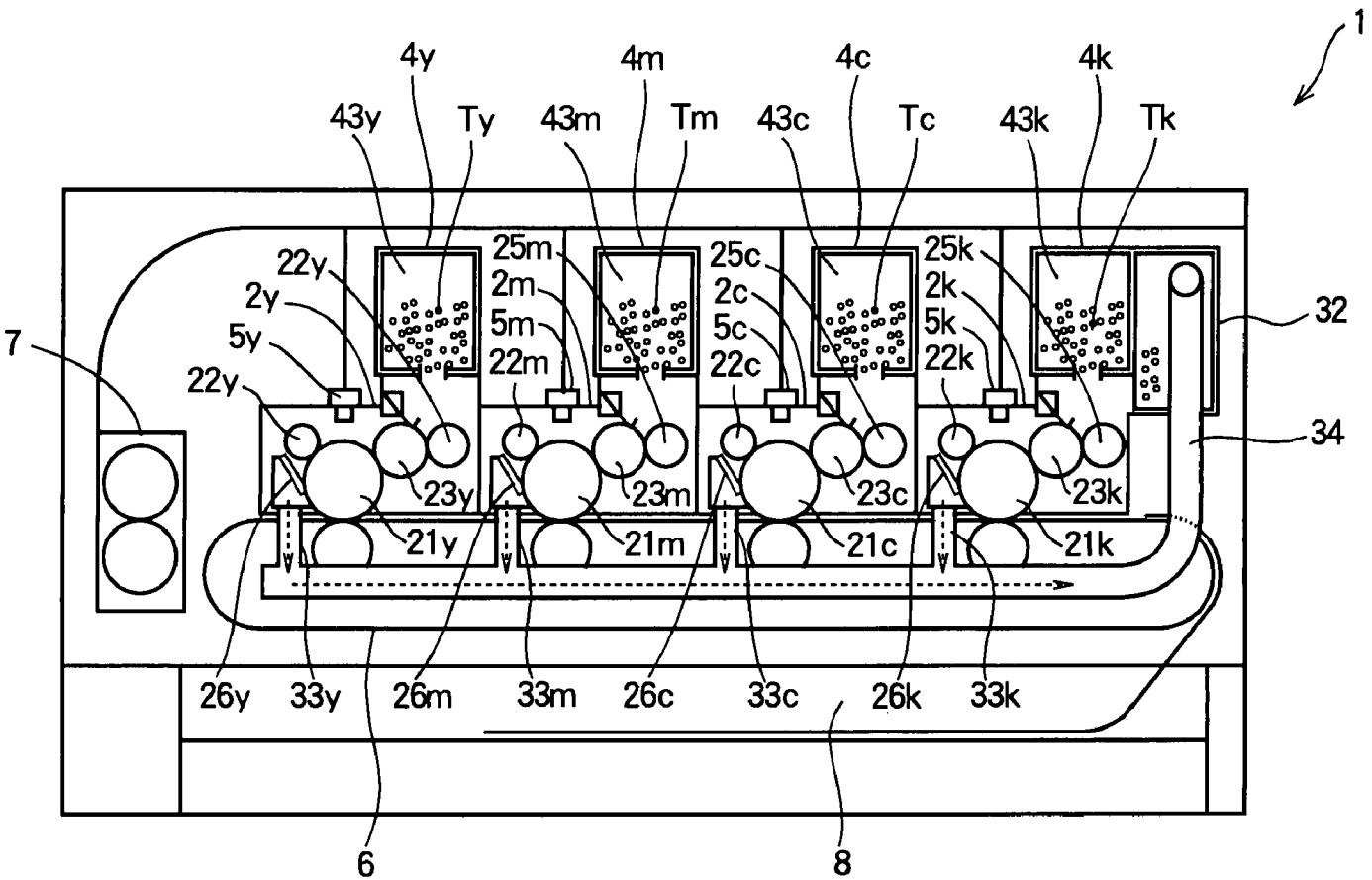
FIG. 1 is a schematic view showing an image forming apparatus according to the first embodiment of the present invention.

FIG. 1 is a schematic view showing, an image forming apparatus 1 according to the first embodiment of the present invention. As shown in FIG. 1, the image forming apparatus 1 includes developing units 2*k*, 2*c*, 2*m* and 2*y* corresponding to colors of black (K), cyan (C), magenta (M) and yellow (Y). The image forming apparatus 1 further includes toner cartridges 4*k*, 4*c*, 4*m* and 4*y* storing toners of the respective colors, LED heads 5*k*, 5*c*, 5*m* and 5*y* as exposure devices, a transferring unit 6, a fixing unit 7 for fixing a toner image to a recording medium, a sheet cassette 8 for storing and feeding the recording medium (for example, sheets), and the like.

The developing units 2*k*, 2*c*, 2*m* and 2*y* are arranged in this order along a feeding path of the recording medium from an upstream side to a downstream side, i.e., from the right to the left in FIG. 1. The developing units (also referred to as image forming units) 2*k*, 2*c*, 2*m* and 2*y* have the same configurations, and include photosensitive drums 21*k*, 21*c*, 21*m* and 21*y* as image bearing bodies, charging rollers 22*k*, 22*c*, 22*m* and 22*y* as charging devices, developing rollers 23*k*, 23*c*, 23*m* and 23*y* for developing latent images on the photosensitive drums 21*k*, 21*c*, 21*m* and 21*y*, developing blades for forming toner layers on the surfaces of the photosensitive drums 21*k*, 21*c*, 21*m* and 21*y*, and supplying rollers 25*k*, 25*c*, 25*m* and 25*y* for supplying the toners to the developing rollers 23*k*, 23*c*, 23*m* and 23*y*. The developing units 2*k*, 2*c*, 2*m* and 2*y* further include cleaning blades 26*k*, 26*c*, 26*m* and 26*y* for removing the residual toners from the surfaces of the photosensitive drums 21*k*, 21*c*, 21*m* and 21*y*, first conveying units 33*k*, 33*c*, 33*m* and 33*y* for conveying waste toners. The developing unit 2*k*, 2*c*, 2*m* and 2*y* constitute an integral unit as a developing device replacement unit 30 (FIG. 2) as described later. The developing device replacement unit 30 is attachable to and detachable from a main body of the image forming apparatus 1. The developing device replacement unit 30 includes a second conveying unit 34.

The toner cartridges 4*k*, 4*c*, 4*m* and 4*y* include toner storing portion 43*k*, 43*c*, 43*m* and 43*y* for storing fresh toners Tk, Tc, Tm and Ty. The toner cartridges 4*k*, 4*c*, 4*m* and 4*y* are disposed respectively above the developing units 2*k*, 2*c*, 2*m* and 2*y*. The toner cartridges 4*k*, 4*c*, 4*m* and 4*y* are individually attachable to and detachable from the developing units 2*k*, 2*c*, 2*m* and 2*y*.

The first conveying units 33*k*, 33*c*, 33*m* and 33*y* are respectively configured to convey the waste toners removed by the cleaning blades 26*k*, 26*c*, 26*m* and 26*y* to a near side in a direction perpendicular to the plane of FIG. 1. The second conveying unit 34 is configured to convey the toner (having been conveyed by the first conveying units 33*k*, 33*c*, 33*m* and 33*y*) collectively to a waste toner storing portion 32 disposed on an upstream side of the image forming apparatus 1 in the arranging direction of the developing units 2*k*, 2*c*, 2*m* and 2*y*. The waste toner storing portion 32 stores the waste toner having been conveyed by the second conveying unit 34. The developing units 2*k*, 2*c*, 2*m* and 2*y*, the toner cartridges 4*k*, 4*c*, 4*m* and 4*y* and the waste toner storing portion 32 are respectively formed as replaceable units each of which can be replaced when lifetime expires (i.e., when the toner is exhausted or when the component is deteriorated).

Figure 2:
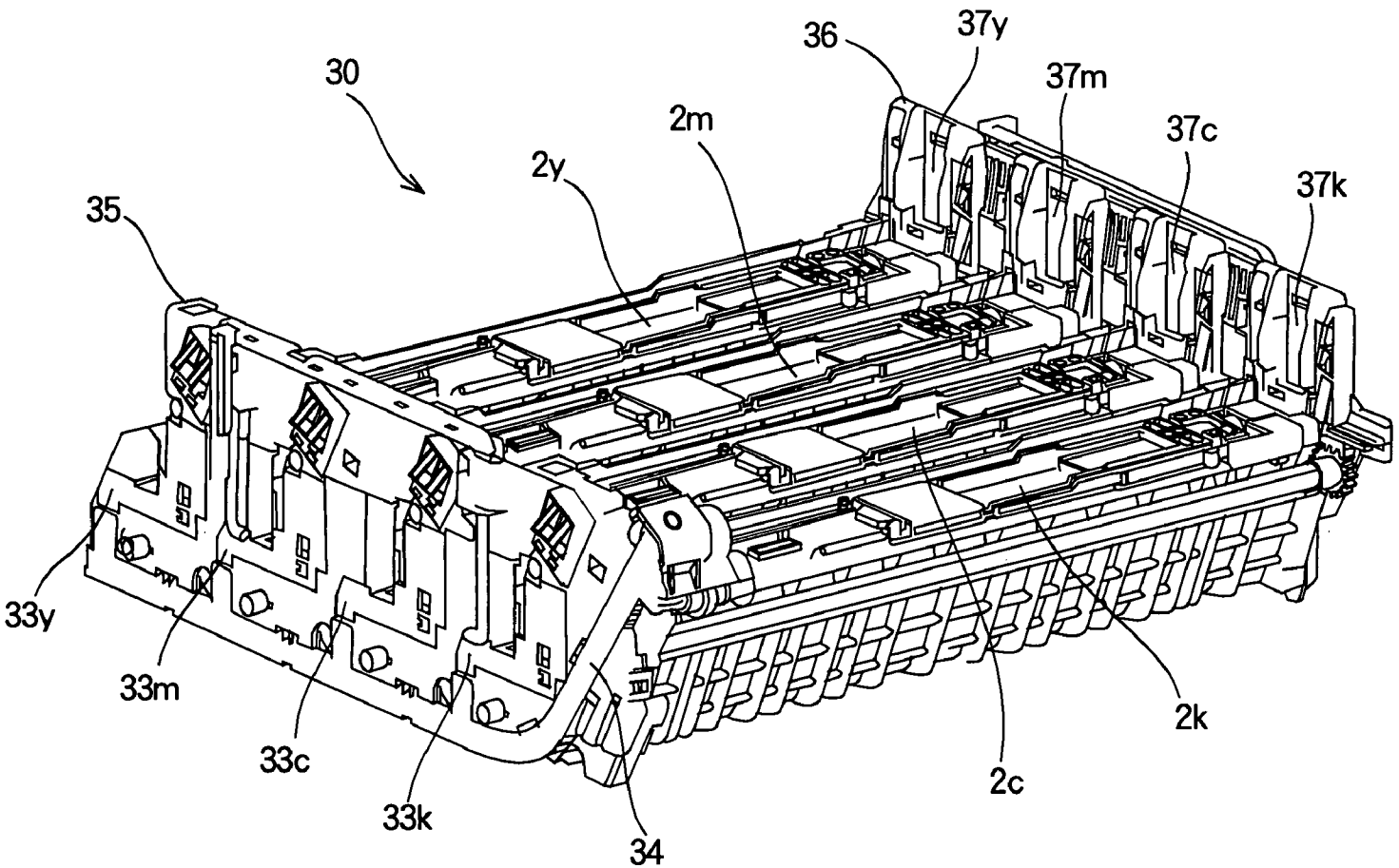
FIG. 2 is a top perspective view showing a developing device replacement unit according to the first embodiment of the present invention.

Next, the developing device replacement unit 30 of the image forming apparatus 1 will be described. FIG. 2 is a perspective view showing the developing device replacement unit 30 according to the first embodiment. As shown in FIG. 2, the developing device replacement unit 30 includes the developing units 2*k*, 2*c*, 2*m* and 2*y* of the respective colors. The developing device replacement unit 30 further includes a first side frame body 35 and a second side frame body 36 that support the developing units 2*k*, 2*c*, 2*m* and 2*y* at both longitudinal sides of the developing units 2*k*, 2*c*, 2*m* and 2*y*. The first and second side frame bodies 35 and 36 have high rigidity, and the developing device replacement unit 30 constitutes an integrally replaceable unit.

The developing units 2*k*, 2*c*, 2*m* and 2*y* have upper spaces to which the toner cartridges 4*k*, 4*c*, 4*m* and 4*y* are respectively mounted. The developing units 2*k*, 2*c*, 2*m* and 2*y* also have portions that are connected to or engaged with toner outlet ports 42 (described later) of the toner cartridges 4*k*, 4*c*, 4*m* and 4*y*. The first conveying units 33*k*, 33*c*, 33*m* and 33*y* and the second conveying unit 34 for conveying the waste toner are disposed on a side portion of the first side frame body 35. Guide grooves 37*k*, 37*c*, 37*m* and 37*y* are formed vertically on the inner side portion of the second side frame body 36 for guiding the toner cartridges 4*k*, 4*c*, 4*m* and 4*y* when the toner cartridges 4*k*, 4*c*, 4*m* and 4*y* are mounted to the upper part of the developing device replacement unit 30.

In this regard, the respective developing units 2*k*, 2*c*, 2*m* and 2*y* with the toner cartridges 4*k*, 4*c*, 4*m* and 4*y* can be referred to as developing devices. The developing devices with the toner cartridges 4*k*, 4*c*, 4*m* and 4*y* being detached are referred to as main bodies of the developing devices.

The toner cartridge mounted to the upper part of the developing device replacement unit 30 will be described. The toner cartridge 4*k*, 4*c*, 4*m* and 4*y* have the same configurations, and therefore will be collectively referred to as a toner cartridge 4.

Figure 3:
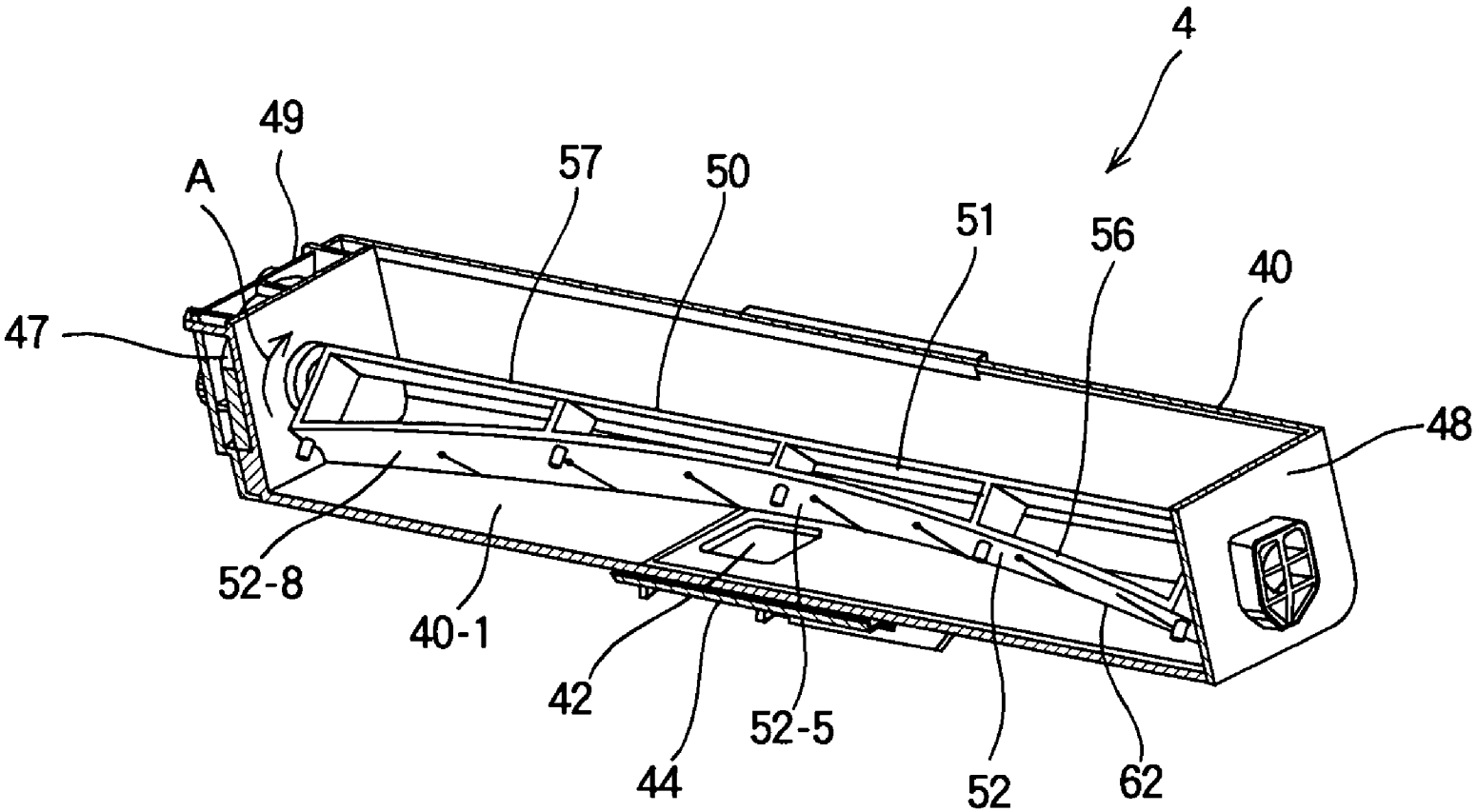
FIG. 3 is a partially cutaway perspective view showing a toner cartridge with an agitation member according to the first embodiment of the present invention.
Figure 4:
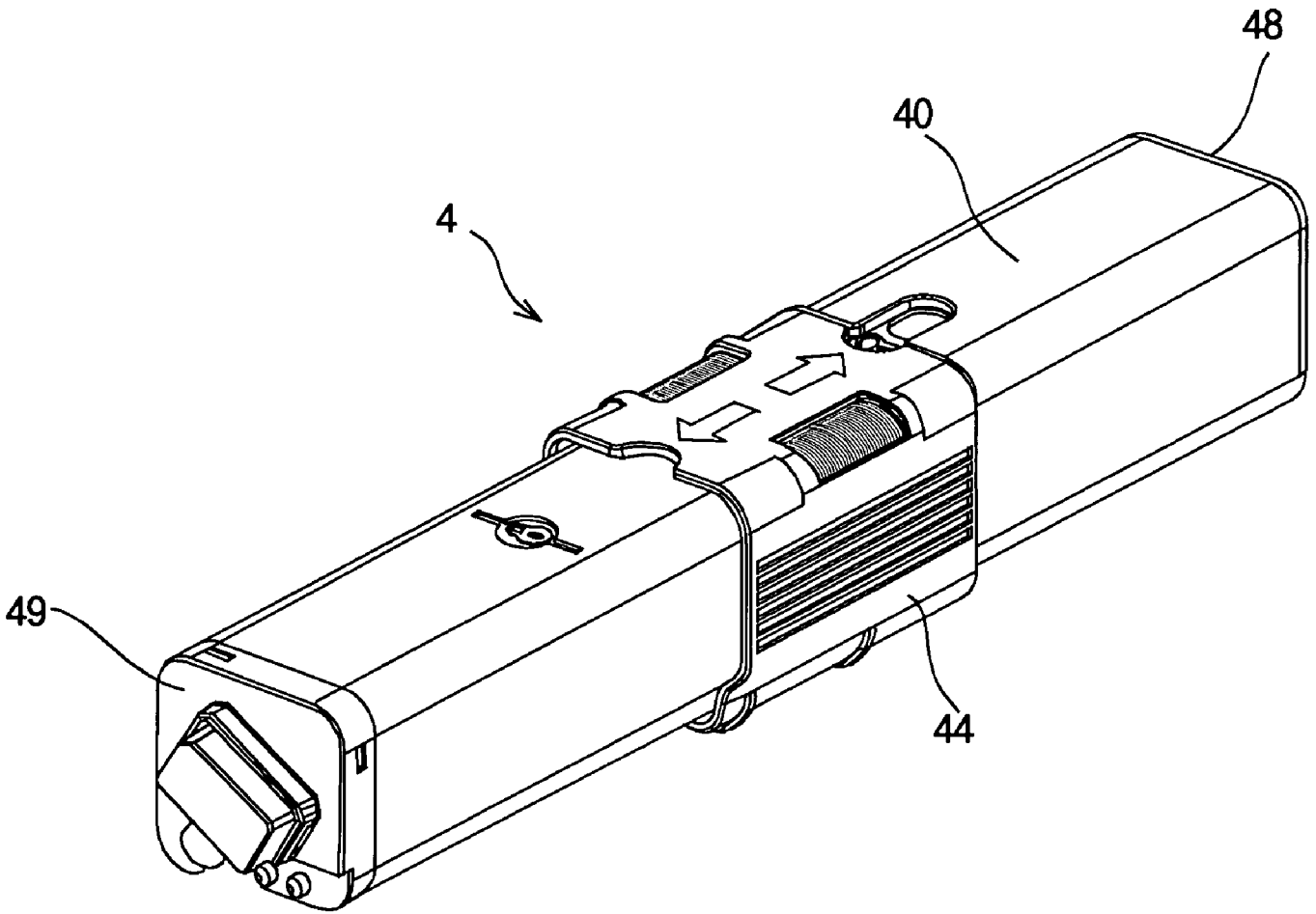
FIG. 4 is a top perspective view showing the toner cartridge according to the first embodiment of the present invention.
Figure 5:
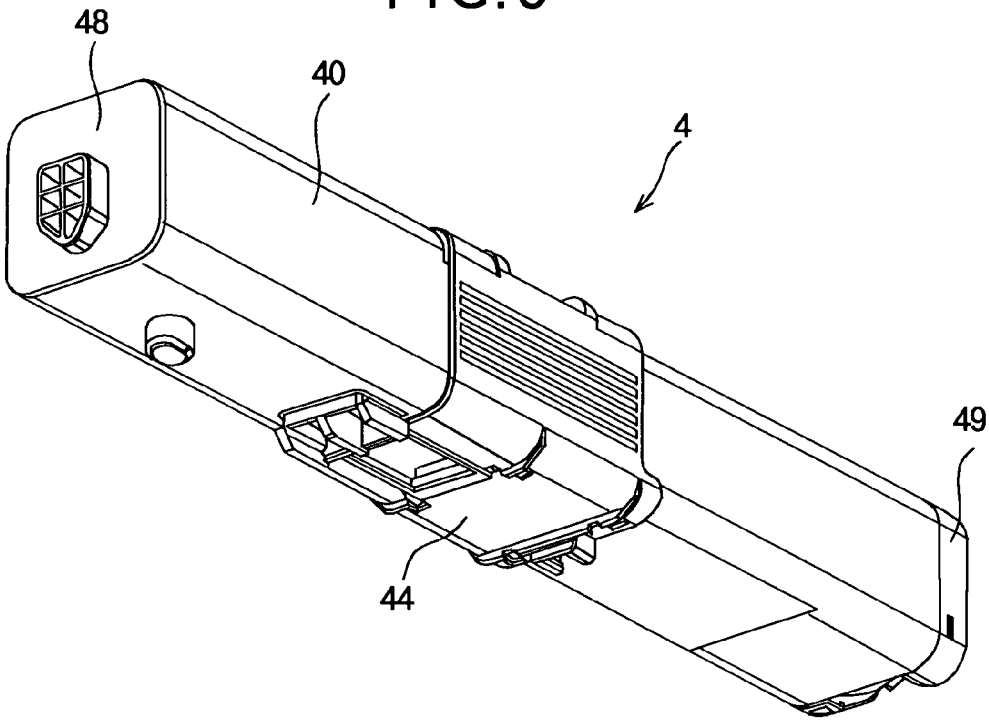
FIG. 5 is a bottom perspective view showing the toner cartridge according to the first embodiment of the present invention.

FIG. 3 is a partially cutaway perspective view of the toner cartridge 4. FIG. 4 is a top perspective view showing the toner cartridge 4. FIG. 5 is a bottom perspective view showing the toner cartridge 4. The toner cartridge (i.e., a developer storing container) 4 has an elongated shape, and includes a toner storing main body 40 having an elongated tubular shape whose cross section is substantially square. The toner storing main body 40 defines a toner storing portion (i.e., a developer storing portion) 43 therein, and a fresh toner T (i.e., a developer) is stored in the toner storing portion 43. A first side cover 48 and a second side cover 49 are provided on both sides of the toner storing main body 40 so as to close the toner storing portion 43. A toner outlet opening (i.e., a developer outlet opening) 42 is formed on a substantially longitudinal center portion of the toner storing main body 40. An outlet opening shutter 44 is also provided on the substantially center portion of the toner storing main body 40 so as to close the toner outlet opening 42. The outlet opening shutter 44 is provided so as to surround the toner storing main body 40. The outlet opening shutter 44 is slidable in the longitudinal direction of the toner storing main body 40 to open and close the toner outlet opening 42.

Figure 6:
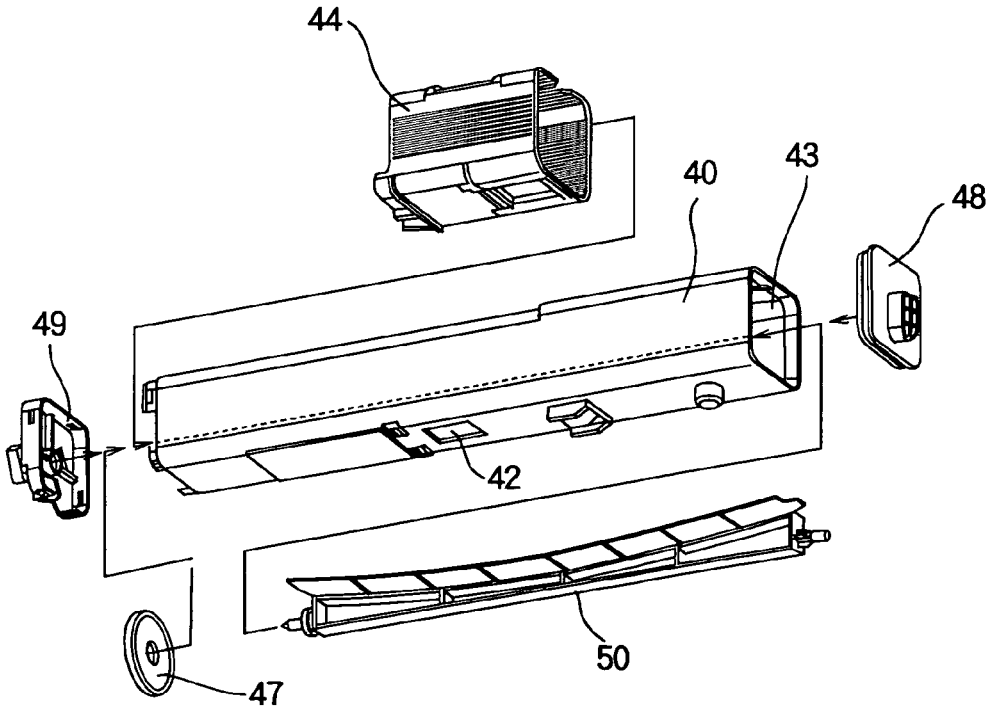
FIG. 6 is an exploded perspective view showing the toner cartridge according to the first embodiment of the present invention.

FIG. 6 is an exploded perspective view showing the toner cartridge 4 according to the first embodiment. The toner storing portion 43 is defined by the toner storing main body 40, the first side cover 48 and the second side cover 49 (on both longitudinal end portions of the toner storing main body 40). An agitation member 50 is provided in the toner storing portion 43, which rotates to agitate the fresh toner T. The agitation member 50 is rotated by an agitation driving gear 47 provided on the second side cover 49. The toner outlet opening 42 is provided on a lower part at a substantially longitudinal center portion of the toner storing main body 40. The fresh toner T falls via the toner outlet opening 42 so as to be supplied to the developing unit 2.

In this specification, the term "longitudinal end portion" is used to indicate an end portion in the longitudinal direction. Further, the term "longitudinal center portion" is used to indicate a center portion in a longitudinal direction. Further, the term "substantially longitudinal center portion" is used to indicate a substantially center portion in a longitudinal direction.

Figure 7B:
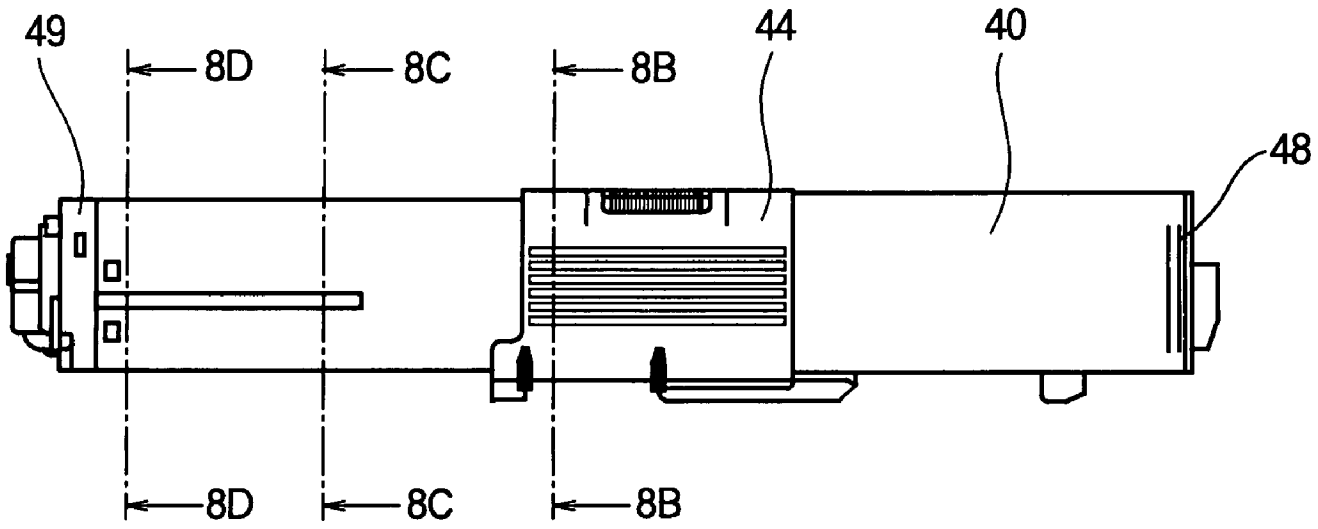
FIGS. 7A and 7B are a side view and a front view showing an outer shape of the toner cartridge according to the first embodiment of the present invention.
Figure 7A:
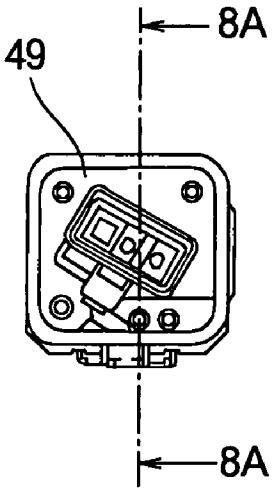
Figure 8A:
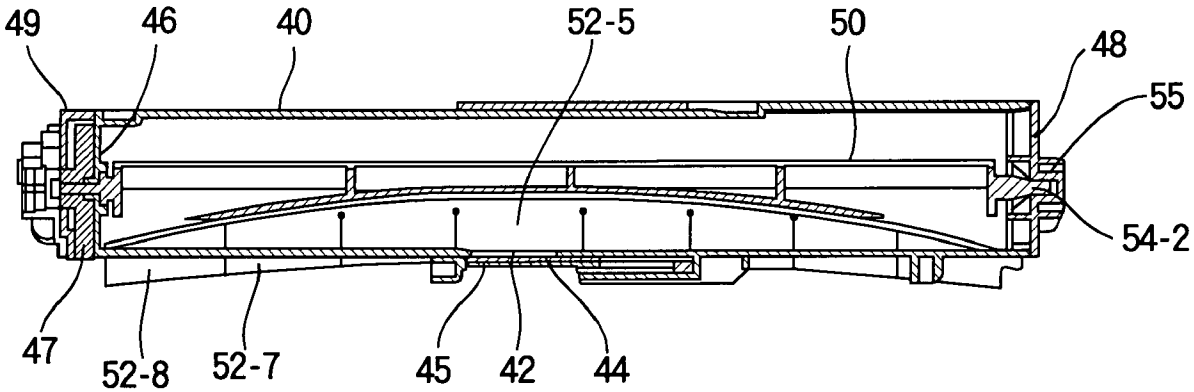
FIG. 8A is a longitudinal sectional view showing the toner cartridge according to the first embodiment of the present invention.
Figure 8B:
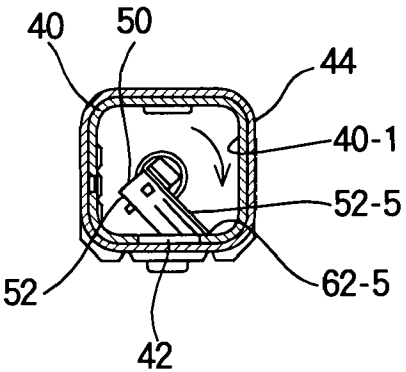
FIGS. 8B, 8C and 8D are cross sectional views showing the toner cartridge according to the first embodiment of the present invention.
Figure 8C:
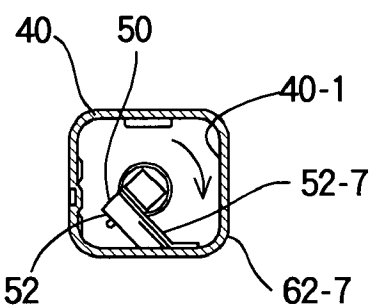
Figure 8D:
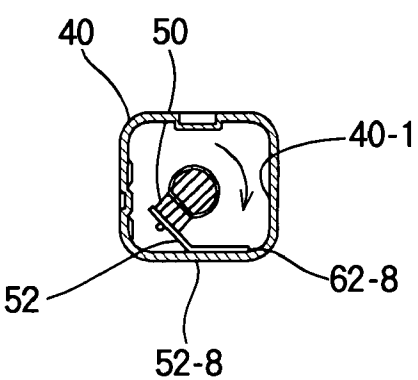

FIGS. 7A and 7B are a left side view and a front view showing the toner cartridge 4 according to the first embodiment. FIG. 8A is a longitudinal sectional view of the toner cartridge 4 taken along line 8A-8A in FIG. 7A. FIGS. 8B, 8C and 8D are sectional views of the toner cartridge 4 respectively taken along lines 8B-8B, 8C-8C and 8D-8D in FIG. 7A.

The agitation member 50 rotates to agitate the fresh toner T and to convey the fresh toner T in the direction toward the substantially longitudinal center portion of the toner cartridge 4, so as to eject the toner to the toner outlet opening 42. Since the toner outlet opening is disposed at the substantially longitudinal center portion of the toner cartridge 4, the agitation member 50 has a symmetrical shape with respect to the substantially longitudinal center portion, and has a special shape as described later.

The agitation member 50 is rotated by the agitation driving gear 47 provided on the second side cover 49 as described above. The agitation driving gear 47 is linked with a driving gear (not shown) of the developing device replacement unit 30. The end of the agitation member 50 opposite to the agitation driving gear 47 is fit into a rotation member bearing portion 55 that rotatably supports the agitation member 50. The toner cartridge 4 further includes an outlet opening seal member 45 which is compressed between the toner outlet opening 42 and the outlet opening shutter member 44 to seal therebetween. The toner cartridge 4 further includes an agitation seal member 46 which is compressed between the agitation member 50 and a shaft hole for the agitation member 50 to seal therebetween. The agitation seal member 46 has both side surfaces with low-friction films contacting the agitation member 50 and the shaft hole, so as not to generate a large load when the agitation member 50 rotates.

Figure 9A:
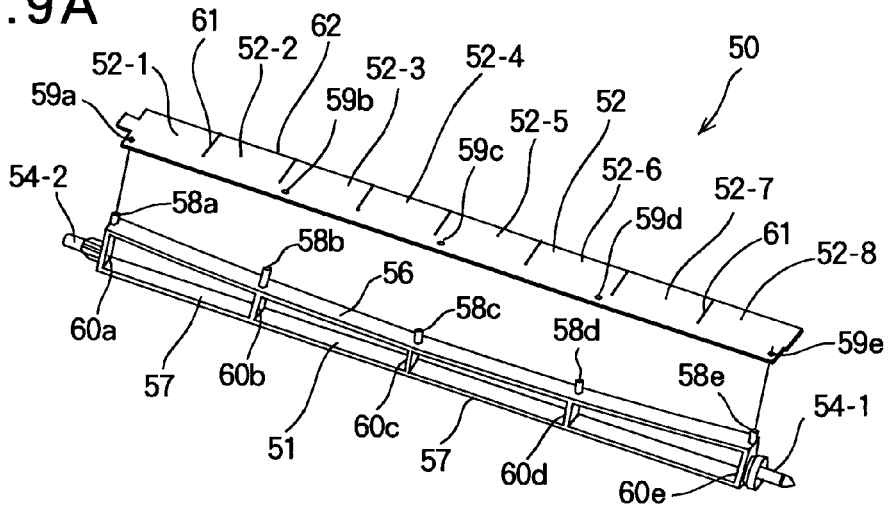
FIGS. 9A and 9B are exploded perspective views showing the agitation member according to the first embodiment of the present invention.
Figure 9B:
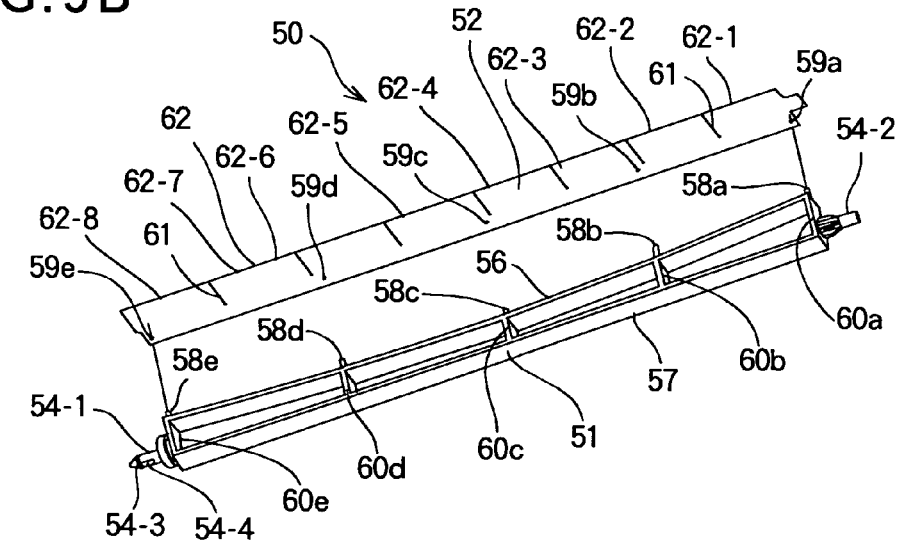
Figure 10:
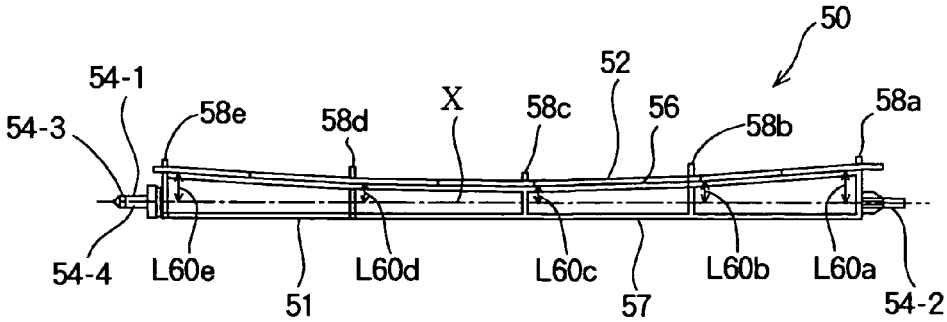
FIG. 10 is a front view showing the agitation member according to the first embodiment of the present invention.

Next, the agitation member 50 will be described. FIGS. 9A and 9B are exploded perspective views of the agitation member 50 as seen from different directions. FIG. 10 is a front view of the agitation member 50. The agitation member 50 includes a rotation member 51 and a flexible member 52. The rotation member 51 includes an arcuate mounting portion 56 to which the flexible member is mounted, an elongated supporting member 57 and a plurality of (in this example, five) connecting members 60*a*, 60*b*, 60*c* and 60*d* connecting the mounting portion 56 and the supporting member 57. Further, a gear-connecting portion 54-1 and a rotation member shaft 54-2 are provided on both longitudinal ends of the agitation member 50. The rotation member 51 rotates about a rotation axis (i.e., a rotation center line) X shown in FIG. 10.

The gear-connecting portion 54-1 is provided on the longitudinal end of the agitation member 50 for transferring rotation to the agitation member 50. The gear-connecting portion 54-1 has a circumferential groove 54-3 and a D-shaped cutout 54-4. The gear-connecting portion 54-1 engages the agitation driving gear 47 (by means of a latch engagement) so as to transmit the rotation from the agitation driving gear 47 to the gear-connecting portion 54-1. The rotation member shaft 54-2 provided on the other side end of the agitation member 50 is fit into the rotation member bearing portion 55 and rotatably supported by the rotation member bearing portion 55.

The elongated supporting portion 57 is elongated along the rotation axis X, and supports the mounting portion 56 via a plurality of connecting members 60*a* through 60*e*. Further, the elongated supporting portion 57 is rotated by the rotation transmitted via the gear-connecting portion 54-1. The mounting portion 56 is elongated in the direction along the rotation axis X, and has an arcuate mounting surface. The mounting surface of the mounting portion 56 is smoothly curved so that a distance from the rotation axis X to the mounting surface increases from the substantially longitudinal center portion toward either longitudinal end portion. The mounting surface of the mounting portion 56 is substantially perpendicular to the radius from the rotation axis X. The mounting portion 56 further has a plurality of (in this example, five) thermal caulking pins 58*a*, 58*b*, 58*c*, 58*d* and 58*e* for mounting the flexible member 52.

The connecting members 60*a*, 60*b*, 60*c*, 60*d* and 60*e* connect the elongated supporting portion 57 and the mounting portion 56 so as to support the elongated supporting portion 57 and the mounting portion 56. The connecting members 60*a* through 60*e* have different lengths. Lengths L60*a*, L60*b*, L60*c*, L60*d* and L60*e* of the connecting members 60*a*, 60*b*, 60*c*, 60*d* and 60*e* satisfy the relationships: L60*c*<L60*b*<L60*a* and L60*c*<L60*d*<L60*e*. In other words, the distance from the rotation axis X to the arcuate mounting portion 56 is the shortest at the substantially longitudinal center portion and is the longest at either longitudinal end portion. With such a structure, the mounting portion 56 is supported in such a manner that the mounting portion 56 has the arcuate shape. Positions of the connecting portions 60*a* through 60*e* are the same as positions of the thermal caulking pins 58*a* through 58*e*.

The flexible member 52 is composed of a rectangular flexible material having a width wider than the width of the mounting portion 56 of the rotation member 51. To be more specific, the flexible member 52 is composed of PET (Polyethylene terephthalate) having a thickness in a range from 50 μm to 200 μm. The flexible member 52 has thermal caulking holes 59*a* through 59*e* corresponding to the thermal caulking pins 58*a* through 58*e* of the mounting portion 56. The thermal caulking pins 58*a* through 58*e* respectively engage the thermal caulking holes 59*a* through 59*e*, and are thermally caulked, so that the flexible member 52 is fixed to the mounting portion 56. With such a structure, the flexible member 52 is fixed to the mounting surface of the mounting portion 56 of the rotation member 51 at a longer side (i.e., a first end) of the rectangular flexible member 52.

The other longer side (i.e., a second end) of the rectangular flexible member 52 faces the above described longer side (the first end) fixed to the mounting portion 56, and defines a sliding end portion 62. When the agitation member 50 rotates, the sliding end portion 62 of the flexible member 52 slides along (i.e., moves in contact with) an inner surface 40-1 of the toner storing main body 40, and the flexible member 52 agitate the fresh toner T to sweep and convey the fresh toner T toward the substantially longitudinal center portion of the toner storing main body 40. Further, the flexible member 52 has a plurality of (in this example, seven) cuts 61 extending from the vicinity of the longer side (i.e., the first end) fixed to the mounting portion 56 toward the sliding end portion 62 (i.e., the second end) of the flexible member 52. The cuts 61 divide the flexible member 52 into a plurality of (in this example, eight) flexible pieces 52-1 through 52-8 in the longitudinal direction of the flexible member 52. The cuts 61 also divide the sliding end portion 62 into a plurality of sliding end portions 62-1 through 62-8, so that the agitation and conveying of the fresh toner T are smoothly performed.

In this regard, the mounting portion 56 is supported by a plurality of connecting members 60*a* through 60*e* having different lengths. Therefore, the mounting surface of the mounting portion 56 is curved in the arcuate shape so that the distance from the rotation axis X to the mounting surface increases from the substantially longitudinal center portion toward either longitudinal end portion of the mounting portion 56. This means that the flexible member 52 is also curved in the arcuate shape along the mounting portion 56, and the sliding end portion 62 of the flexible member 52 is also curved in the arcuate shape along the mounting portion 56.

Next, an operation of the agitation member 50 according to the first embodiment will be described with reference to FIGS. 3, 8 and 11. FIG. 3 shows an internal structure of the toner cartridge 4 in such a manner that front and top portions are removed. The agitation driving gear 47 of the toner cartridge 4 is rotated by the driving force transmitted from the above described developing device replacement unit 30, and the agitation member 50 rotates in the direction indicated by an arrow A via the gear connecting portion 54-1. By the rotation of the agitation member 50, the flexible member 52 mounted to the mounting portion 56 of the rotation member 51 also rotates. With the rotation of the flexible member 52, the sliding end portion 62 of the flexible member 52 slides along the inner surface 40-1 of the toner storing main body 40 to thereby scrape off the fresh toner T from the inner surface 40-1 of the toner storing main body 40.

A sliding between the sliding end portion 62 of the flexible member 52 and the inner surface 40-1 of the toner storing main body 40 is shown in FIGS. 8B, 8C and 8D. The flexible piece 52-5 at the substantially longitudinal center portion of the agitation member 50 rotates so that the flexible piece 52-5 is deflected as shown in FIG. 8B, and the sliding end portion 62-5 slides along the inner surface 40-1 of the toner storing main body 40. The flexible pieces 52-7 and 52-8 at the longitudinal end portion of the agitation member 50 respectively rotate so that the flexible pieces 52-7 and 52-8 are deflected as shown in FIGS. 8C and 8D, and the sliding end portions 62-7 and 62-8 slide along the inner surface 40-1 of the toner storing main body 40.

Figure 11:
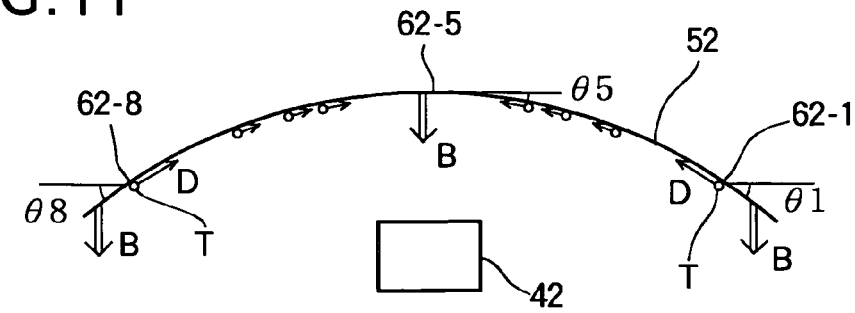
FIG. 11 is a schematic view showing a toner conveying operation of a flexible member of the agitation member according to the first embodiment of the present invention.

FIG. 11 is a schematic view for illustrating a toner conveying operation by the flexible member 52. To be more specific, FIG. 11 schematically shows the shape of the flexible member 52 of FIG. 3 as seen from above. The sliding end portions 62-1 and 62-8 at both longitudinal end portions and the sliding end portion 62-5 at the substantially longitudinal center portion rotate in a direction shown by arrows B in FIG. 11, which is defined as a sliding direction. Due to the arcuate shape of the flexible member 52, the sliding end portions 62-1 and 62-8 (at both longitudinal end portions) slide along the inner surface 40-1, ahead of the sliding end portion 62-5 (at the substantially longitudinal center portion). Further, due to the arcuate shape of the flexible member 52, each of angles θ1 and θ8 respectively between the sliding end portion 62-1 and 62-8 (at both longitudinal end portions) and a direction perpendicular to the sliding direction B is greater than an angle θ5 between the sliding end portion 62-5 (at the substantially longitudinal center portion) and the direction perpendicular to the sliding direction B. Therefore, the toner T is pushed (in a sweeping manner) by the sliding end portions 62-1 through 62-8 of the flexible pieces 52-1 through 52-8 toward the substantially longitudinal center portion as indicated by arrows D. The toner T is collected at the substantially longitudinal center portion, and is supplied to the developing device replacement unit 30 via the toner outlet opening 42 disposed at the substantially longitudinal center portion. Therefore, the toner T in the toner cartridge 4 can be efficiently used, and the amount of unusable toner in the toner cartridge 4 can be reduced.

Figure 12A:
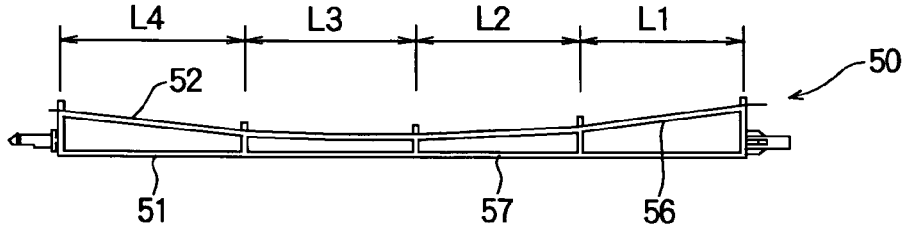
FIGS. 12A and 12B are schematic views showing modifications of a mounting portion of the agitation member according to the first embodiment of the present invention.
Figure 12B:
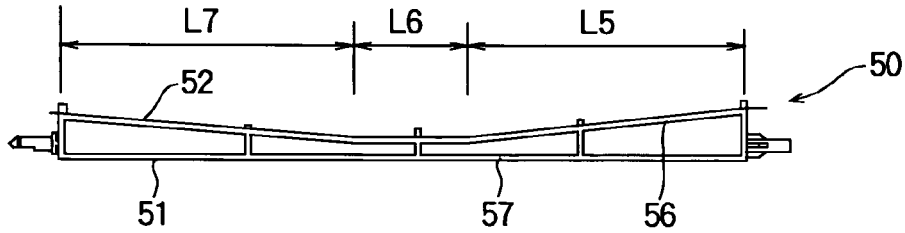

Next, modifications of the mounting portion 56 of the first embodiment will be described. FIGS. 12A and 12B respectively show modifications of the mounting portion 56 of the agitation member 50 of the first embodiment. As shown in FIG. 12A, the mounting portion 56 (to which the flexible member 52 is mounted) can be composed of a plurality of planar portions L1, L2, L3 and L4 having different inclinations. As shown in FIG. 12B, the mounting portion 56 can include a planar portion L6 having no inclination at the substantially longitudinal center portion, and two planar portions L5 and L7 having inclinations at both sides of the planar portion L6. That is, the above described effect of the first embodiment can be achieved when the mounting portion 56 has substantially arcuate shape as a whole.

Further, although it has been described that the rotation member 51 of the agitation member 50 and the flexible member 52 are fixed to each other by thermal caulking, it is also possible to use double-sided adhesion tape, adhesive agent, latches or the like instead of thermal caulking.

As described above, according to the first embodiment of the present invention, the agitation member 50 includes the mounting portion 56 having substantially arcuate shape, and the flexible member 52 is mounted to the mounting portion 56 in such a manner that the flexible member 52 has substantially arcuate shape. Therefore, the sliding end portions 62-1 and 62-8 at both longitudinal end portions of the agitation member 50 slide along the inner surface 40-1 of the toner storing main body 40, ahead of the sliding end portion 62-5 at the substantially longitudinal center portion of the agitation member 50. Further, the sliding end portions 62-1 and 62-8 at both longitudinal end portions are inclined at a larger angle with respect to the direction perpendicular to the sliding direction B, compared with the sliding end portion 62-5 at the substantially longitudinal center portion.

With such a configuration, the toner T is efficiently collected at the substantially longitudinal center portion of the agitation member 50, and is supplied to the developing device replacement unit 30 via the toner outlet opening 42. Thus, it becomes possible to reduce the amount of unusable toner in the toner cartridge 4.

Particularly, the flexible member 52 is divided by the cuts 61 into a plurality of the flexible pieces 52-1 through 52-8 in the longitudinal direction of the flexible member 52. Therefore, a smooth movement of the sliding end portion 62 of the flexible member 52 can be achieved, in a configuration in which the sliding end portions 62-1 and 62-8 (at both longitudinal end portions) slides along the inner surface 40-1, ahead of the sliding end portion 62-5 (at the substantially longitudinal center portion), and in which the sliding end portions 62-1 and 62-8 are inclined at larger angles (with respect to the direction perpendicular to the sliding direction B) than the sliding end portion 62-5. Further, the agitation member 50 has the flexible member 52 at the tip thereof. Therefore, even when the toner cartridge 4 has substantially square cross section, the agitation member 50 can even convey the toner T located at corners of the toner storing portion 43 of the toner cartridge 4 using the sliding end portions 62 of the flexible members 52. Thus, the toner T is efficiently collected at the substantially longitudinal center portion, and is supplied to the developing device replacement unit 30 via the toner outlet opening 42, with the result that the amount of unusable toner in the toner cartridge 4 is effectively reduced. As a result, it becomes possible to obtain an environmentally friendly developer storing container (i.e., the toner cartridge 4) capable of providing sufficient amount of toner for printing as desired and reducing the amount of unusable toner.

Second Embodiment

The second embodiment of the present invention will be described. The electrophotographic process in the second embodiment is the same as that in the first embodiment, and therefore duplicate explanations will be omitted.

Figure 13:
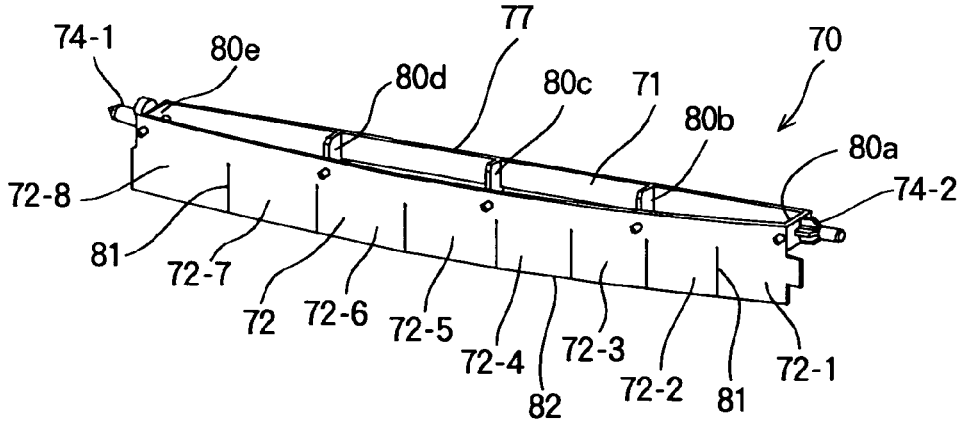
FIG. 13 is a perspective view showing an agitation member according to the second embodiment of the present invention.
Figure 14:
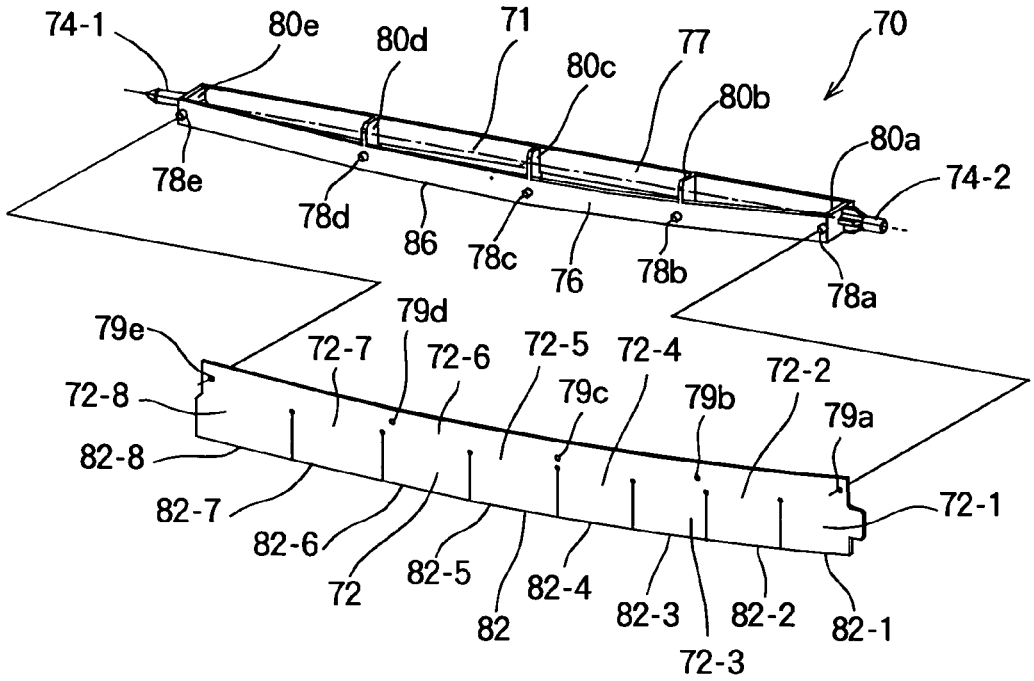
FIG. 14 is an exploded perspective view showing the agitation member according to the second embodiment of the present invention.
Figure 15:
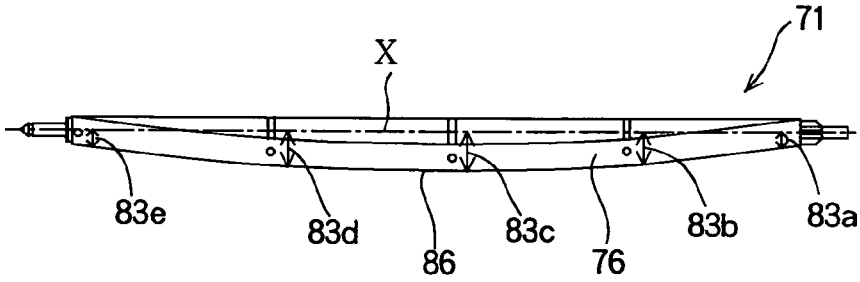
FIG. 15 is a front view showing a rotation member of the agitation member according to the second embodiment of the present invention.
Figure 16:
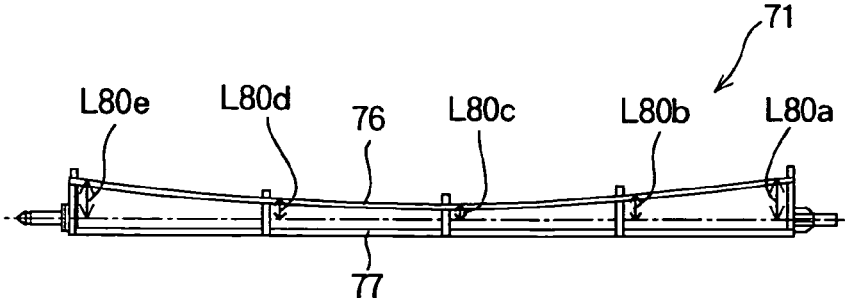
FIG. 16 is a bottom view of the rotation member of the agitation member according to the second embodiment of the present invention.

FIGS. 13 and 14 are a perspective view and an exploded perspective view showing an agitation member 70 according to the second embodiment of the present invention. FIGS. 15 and 16 are a front view and a bottom view showing a rotation member 71 of the agitation member 70. The agitation member 70 of the second embodiment includes a rotation member 71 and a flexible member 72 mounted to the rotation member 71 as in the first embodiment. The second embodiment is different from the first embodiment in that a mounting portion 76 of the rotation member 71 has a lower end portion 86 curved so that a distance from the rotation axis X of the rotation member 71 to the lower end portion 86 increases from either longitudinal end portion toward the substantially longitudinal center portion of the rotation member 71.

The rotation member 71 includes the mounting portion 76 of an arcuate shape to which the flexible member 72 is mounted, an elongated supporting portion 77 and a plurality of connecting portions 80*a* through 80*e* that connect the flexible member 72 and the elongated supporting portion 77. A gear connecting portion 74-1 and a rotation member shaft 74-2 are provided on both ends of the elongated supporting portion 77 as in the first embodiment. The rotation member 71 rotates about the rotation axis X shown in FIG. 15. The elongated supporting portion 77 is elongated along the rotation axis X. The elongated supporting portion 77 supports the mounting portion 76 via the connecting members 80, and is rotated by a rotation force transmitted via the gear connecting portion 74-1.

The mounting portion 76 has an elongated shape along the rotation axis X, and has an arcuate mounting surface. As shown in the bottom view of FIG. 16, the mounting surface of the mounting portion 76 is smoothly curved so that a distance from the rotation axis X to the mounting surface increases from the substantially longitudinal center portion toward either longitudinal end portion. The mounting surface of the mounting portion 76 is perpendicular to the radius from the rotation axis X. As seen in front view of FIG. 15, the mounting portion 76 is curved in a sword shape so that the distance from the rotation axis X to the mounting portion 76 increases from the substantially longitudinal center portion toward either longitudinal end portion. To be more specific, the lower end portion 86 (i.e., one of longer sides) of the mounting portion 76 is curved in a sword shape so that the distance from the rotation axis X to the lower end portion 86 increases from the substantially longitudinal center portion toward either longitudinal end portion. In FIG. 15, distances 83*a*, 83*b*, 83*c*, 83*d* and 83*e* from the rotation axis X to the lower end portion 86 of the mounting portion at equally distanced five points satisfy the relationships: 83*c*>83*b*>83*a*, and 83*c*>83*d*>83*e*.

In this regard, the term "sword shape" is used to indicate the shape of an elongated member curved in a width direction thereof. In contrast, the term "arcuate shape" is used to indicate the shape of an elongated member curved in a thickness direction.

Thermal caulking pins 78*a* through 78*e* are provided on the same positions as the connecting members 80*a* through 80*e*. The flexible member 72 has thermal caulking holes 79*a* through 79*e*. The thermal caulking holes 79*a* through 79*e* engage the thermal caulking pins 78*a* through 78*e*, and the thermal caulking pins 78*a* through 78*e* protruding through the flexible member 72 are thermally caulked, so that the flexible member 72 is fixed to the rotation member 71. The flexible member 72 is inclined (curved) along the mounting portion 76.

The connecting members 80*a* through 80*e* connect the elongated supporting portion 77 and the mounting portion 76 so as to hold the elongated supporting portion 77 and the mounting portion 76. The connecting members 80*a* through 80*e* have different lengths. Lengths L80*a*, L80*b*, L80*c*, L80*d* and L80*e* of the connecting members 80*a* through 80*e* satisfy the relationships: L80*c*<L80*b*<L80*a* and L80*c*<L80*d*<L80*e*. In other words, the distance from the rotation axis X to the mounting portion 76 is the shortest at the substantially longitudinal center portion and is the longest at either longitudinal end portion. With such a structure, the mounting portion 76 is supported so as to have an arcuate shape.

The flexible member 72 is composed of an elongated rectangular flexible material having a width wider than the width of the mounting portion 76 of the rotation member 71, and is curved in a sword shape along the mounting portion 76. To be more specific, the flexible member 72 is composed of PET (Polyethylene terephthalate) having a thickness in a range from 50 μm to 200 μm. The flexible member 72 has the thermal caulking holes 79*a*, 79*b*, 79*c*, 79*d* and 79*e* respectively engaging the thermal caulking pins 78*a* through 78*e* of the mounting portion 76. With such a structure, the flexible member 72 is fixed to the mounting surface of the mounting portion 76 of the rotation member 71 at a longer side of the rectangular flexible member 72.

The other longer side of the rectangular flexible member 72 faces the above described longer side fixed to the mounting portion 76, and forms a sliding end portion 82. When the agitation member 70 rotates, the sliding end portion 82 of the flexible member 72 slides along an inner surface 40-1 of the toner storing main body 40 to agitate the fresh toner T and convey the fresh toner T toward the substantially longitudinal center portion of the toner storing main body 40.

Further, the flexible member 72 has a plurality of (in this example, seven) cuts 81 extending from the vicinity of the longer side fixed to the mounting portion 76 toward the sliding end portion 82 of the flexible member 72. The cuts 81 divide the flexible member 72 into a plurality of (in this example, eight) flexible pieces 72-1 through 72-8 in the longitudinal direction of the flexible member 72. The cuts 81 also divide the sliding end portion 82 into a plurality of sliding end portions 82-1 through 82-8. Therefore, a smooth movement of the sliding end portions 82 of the flexible member 72 can be achieved, in a configuration in which the sliding end portions 82-1 and 82-8 at both longitudinal end portions slide along the inner surface 40-1 of the toner storing main body 40, ahead of the sliding end portion 82-5 at the substantially longitudinal center portions, and in which the sliding end portions 82-1 and 82-8 are inclined at larger angles (with respect to the direction perpendicular to the sliding direction) than the sliding end portion 82-5.

In this regard, the mounting portion 76 is supported by a plurality of connecting members 80*a* through 80*e* having different lengths. Therefore, the mounting surface of the mounting portion 76 is curved in the arcuate shape so that the distance from the rotation axis X to the mounting surface increases from the substantially longitudinal center portion toward either longitudinal end portion of the mounting portion 76. This means that the flexible member 72 is also curved in the arcuate shape along the mounting portion 76. In contrast, the lower end 86 of the mounting portion 76 is curved in the sword shape as shown in the front view of FIG. 15. Along the mounting portion 86, the sliding end portion 82 of the flexible member 72 is smoothly curved in the sword shape so that the distance from the rotation axis X to the sliding end portion 82 increases from either longitudinal end portion toward the substantially longitudinal center portion. Based on this relationship, the distance from the rotation axis X to the sliding end portion 82 of the flexible member 72 is substantially constant throughout the entire length of the flexible member 72.

Figure 17A:
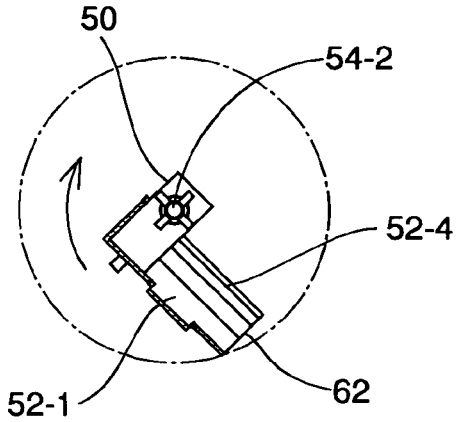
FIGS. 17A and 17B are schematic views for illustrating a difference between the agitation members of the first and second embodiments.
Figure 17B:
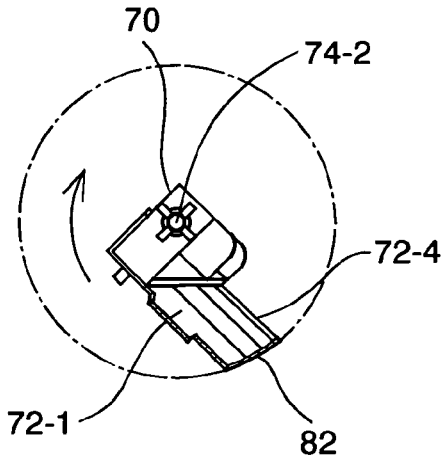

FIGS. 17A and 17B show comparison between the agitation member 50 of the first embodiment and the agitation member 70 of the second embodiment. To be more specific, FIG. 17A is a schematic view showing the agitation member 50 of the first embodiment as seen in the direction from the rotation member shaft 54-2, and FIG. 17B is a schematic view showing the agitation member 70 of the first embodiment as seen in the direction from the rotation member shaft 74-2. The toner storing main body 40 of the toner cartridge 4 has substantially square cross section as described above. FIGS. 17A and 17B show respective trajectories of rotations of the sliding end portions 62 and 82 of the flexible members 52 and 72. According to the first embodiment, as shown in FIG. 17A, the radius of rotation of the sliding end portion 62 of the flexible piece (for example, 52-4) at the substantially longitudinal center portion is smaller than the radius of rotation of the sliding end portion 62 of the flexible piece (for example, 52-1) at both longitudinal end portions. Where the radius of rotation of the sliding end portion 62 is comparatively small, there is a possibility that the fresh toner T in the vicinity of the inner surface 40-1 of the toner storing main body 40 may not be sufficiently scraped off.

In contrast, according to the second embodiment, as shown in FIG. 17B, the radius of rotation of the sliding end portion 82 of the flexible piece (for example, 72-4) at the substantially longitudinal center portion is substantially the same as the radius of rotation of the sliding end portion 82 of the flexible piece (for example, 72-1) at both longitudinal end portions. Therefore, it is ensured that the fresh toner T can be scraped off from the inner surface 40-1 of the toner storing main body 40, and the amount of unusable toner T can be reduced throughout the entire length of the toner storing main body 40.

Figure 18A:
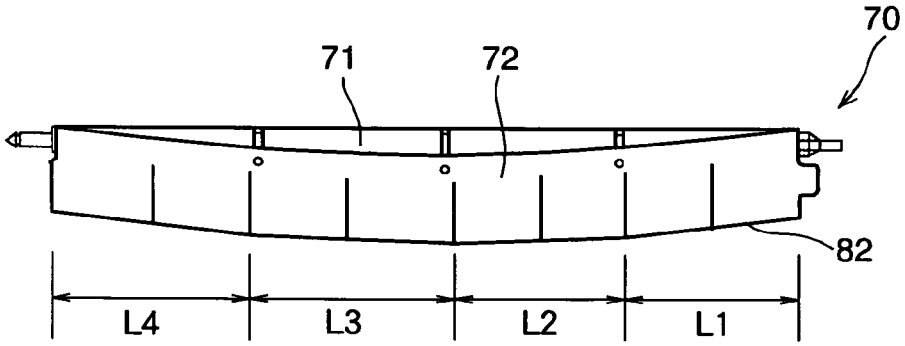
FIGS. 18A and 18B are schematic views showing modifications of a flexible member of the agitation member according to the second embodiment.
Figure 18B:
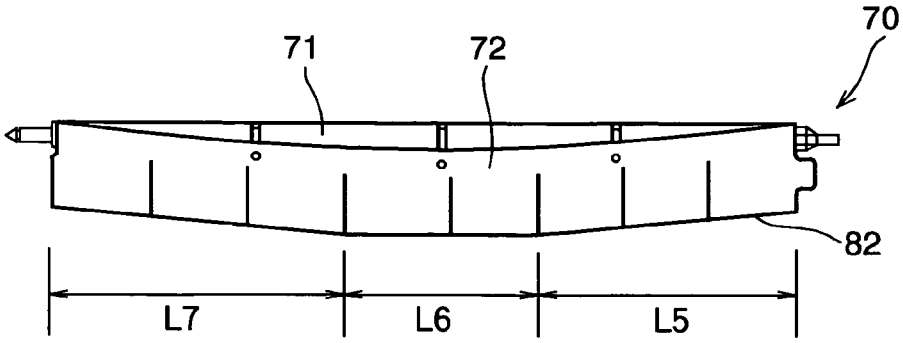

Next, modifications of the flexible member 72 of the second embodiment will be described. FIGS. 18A and 18B show modifications of the flexible member 72 of the agitation member 70 of the second embodiment. In above description, the sliding end portion 82 of the flexible member 72 is smoothly curved in the sword shape so that the distance from the rotation axis X to the sliding end portion 82 increases from either longitudinal end portion toward the substantially longitudinal center portion. However, the flexible member 72 of the agitation member 70 of the second embodiment is not limited to such a structure. As shown in FIG. 18A, the sliding end portion of the flexible member 72 can be composed of a plurality of straight portions L1, L2, L3 and L4 having different inclinations. Further, as shown in FIG. 18B, the sliding end portion 82 of the flexible member 72 can be composed of a straight portion L6 having no inclination at the substantially longitudinal center portion and straight portions L5 and L7 having inclinations at both sides of the straight portion L6. That is, the above described effect of the second embodiment can be achieved when the flexible member 72 is substantially curved in the sword shape as a whole.

Further, although it has been described that the rotation member 71 of the agitation member 70 and the flexible member 72 are fixed to each other by thermal caulking, it is also possible to use double-sided adhesion tape, adhesive agent, latches or the like instead of thermal caulking.

As described above, according to the second embodiment, the agitation member 70 includes the mounting portion 76 having the arcuate shape to which the flexible member 72 is mounted so as to have the arcuate shape. Further, the sliding end portion 82 is formed so that the distance from the rotation axis X to the sliding end portion 82 increases from either longitudinal end portion toward the substantially longitudinal center portion. Therefore, the distance from the rotation axis X to the sliding end portion 82 is substantially constant throughout the entire length of the sliding end portion 82. The sliding end portion 82 at both longitudinal ends of the agitation member 70 slide along the inner surface 40-1 of the toner storing main body 40, ahead of the sliding end portion 82 at the substantially longitudinal center portion of the agitation member 70, and the sliding end portions 82 at both longitudinal end portions are inclined at larger angles with respect to the direction perpendicular to the sliding direction than the sliding end portion 62 at the substantially longitudinal center portion. With such a configuration, it becomes possible to further reduce the amount of unusable toner in the toner cartridge 4 throughout the entire length of the toner cartridge 4, compared with the first embodiment. As a result, it becomes possible to obtain an environmentally friendly developer storing container (i.e. the toner cartridge 4) capable of providing sufficient amount of toner for printing as desired and reducing the amount of unusable toner.

Particularly, the flexible member 72 is divided by the cuts 81 into a plurality of the flexible pieces 72-1 through 72-8 in the longitudinal direction of the flexible member 72. Therefore, a smooth movement of the sliding end portion 82 of the flexible member 72 can be achieved, in a configuration in which the sliding end portions 82-1 and 82-8 of the flexible pieces 72-1 and 72-8 at both longitudinal end portions slide along the inner surface 40-1 of the toner storing main body 40, ahead of the sliding end portion 82-5 of the flexible piece 72-5 at the substantially longitudinal center portion, and in which the sliding end portions 82-1 and 82-8 are inclined at larger angles (with respect to the direction perpendicular to the sliding direction) than the sliding end portion 82-5. Further, the agitation member 70 has the flexible member 72 at the tip thereof, and therefore, even when the toner cartridge 4 has substantially square cross section, the agitation member 70 can even convey the fresh toner T located at corners of the toner storing portion 43 of the toner cartridge 4 using the sliding end portions 82 of the flexible member 72.

Third Embodiment

Next, the third embodiment of the present invention will be described. The electrophotographic process in the third embodiment is the same as that in the first embodiment, and therefore duplicate explanations will be omitted.

Figure 19:
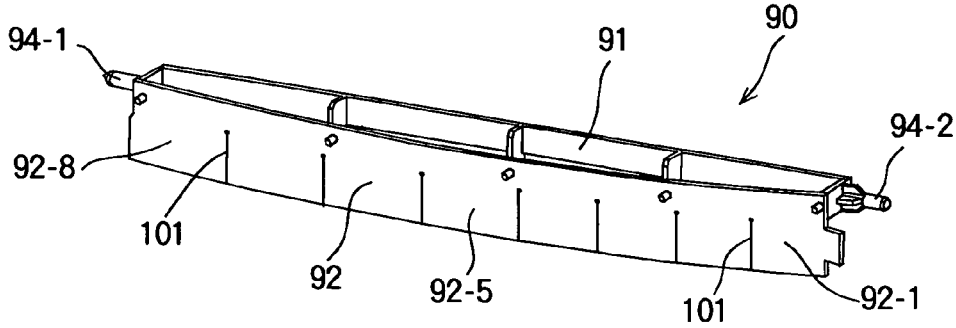
FIG. 19 is a perspective view showing an agitation member according to the third embodiment of the present invention.
Figure 20:
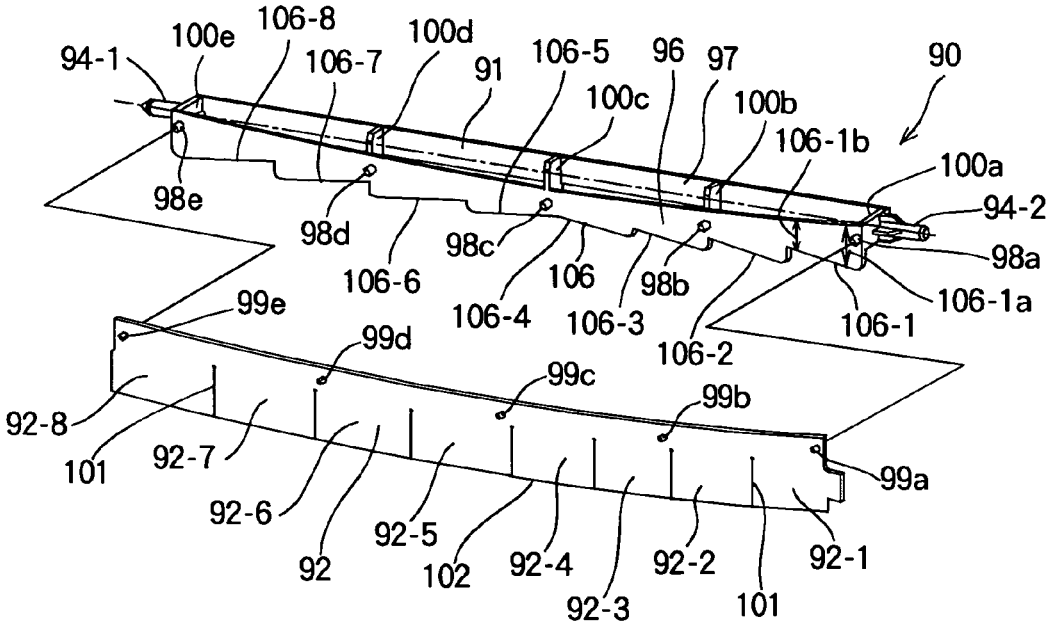
FIG. 20 is an exploded perspective view of the agitation member according to the third embodiment of the present invention.
Figure 21:
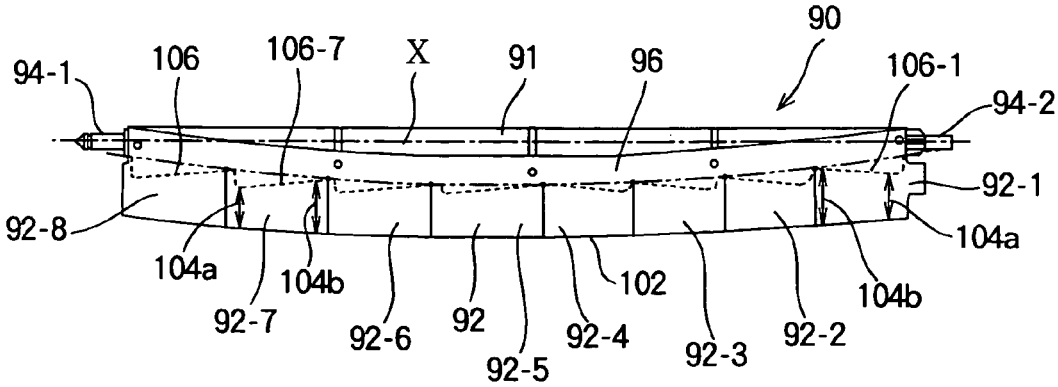
FIG. 21 is a front view showing the agitation member according to the third embodiment of the present invention.
Figure 22:
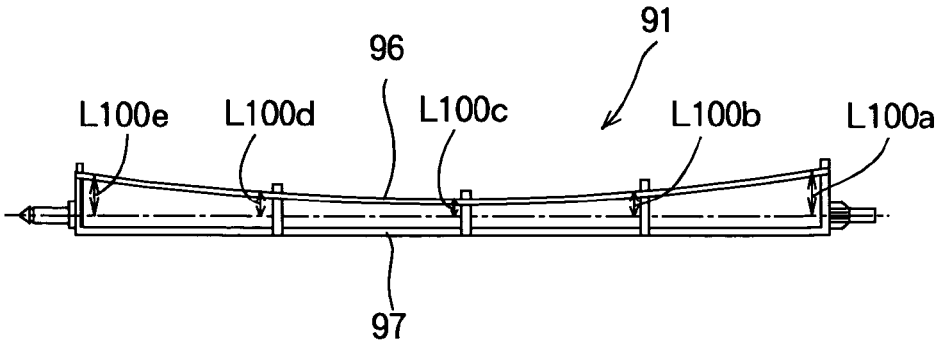
FIG. 22 is a bottom view showing a rotation member of the agitation member according to the third embodiment of the present invention.

FIGS. 19, 20 and 21 are a perspective view, an exploded perspective view and a front view showing an agitation member 90 according to the third embodiment of the present invention. FIG. 22 is a bottom view showing a rotation member 91 of the agitation member 90. The agitation member 90 of the third embodiment includes a rotation member 91 and a flexible member 92 mounted to the rotation member 91 as in the second embodiment. The third embodiment is different from the second embodiment in the shape of a mounting portion 96 of the rotation member 91 as described blow.

The rotation member 91 includes the mounting portion 96 of an arcuate shape to which the flexible member 92 is mounted, an elongated supporting portion 97 and a plurality of connecting members 100*a* through 100*e* that connect the flexible member 92 and the elongated supporting portion 97. A gear connecting portion 94-1 and a rotation member shaft 94-2 are provided on both ends of the elongated supporting portion 97 as in the first embodiment. The rotation member 91 rotates about the rotation axis X shown in FIG. 21. The elongated supporting portion 97 is elongated along the rotation axis X. The elongated supporting portion 97 supports the mounting portion 96 via the connecting members 100*a* through 100*e*, and is rotated by a rotation force transmitted via the gear connecting portion 94-1.

The mounting portion 96 has an elongated shape along the rotation axis X, and has an arcuate mounting surface. The mounting surface of the mounting portion 96 is smoothly curved so that a distance from the rotation axis X to the mounting surface increases from the substantially longitudinal center portion toward either longitudinal end portion. The mounting surface of the mounting portion 96 is perpendicular to the radius from the rotation axis X. As shown in front view of FIG. 21, the mounting portion 96 is curved in a sword shape so that a distance from the rotation axis X to the mounting portion 96 increases from the substantially longitudinal center portion toward either longitudinal end portion. Furthermore, the mounting portion 96 has a saw-toothed end portion 106 facing the sliding end portion 102.

The mounting portion 96 has thermal caulking pins 98*a* through 98*e* provided on the same positions as the connecting members 100*a* through 100*e*. The flexible member 92 has thermal caulking holes 99*a* through 99*e*. The thermal caulking pins 98*a* through 98*e* engage the thermal caulking holes 99*a* through 99*e*, and the thermal caulking pins 98*a* through 98*e* protruding through the flexible member 92 are thermally caulked, so that the flexible member 92 is fixed to the rotation member 91. With such a structure, the flexible member 92 is inclined along the mounting portion 96.

The connecting members 100*a* through 100*e* connect the elongated supporting portion 97 and the mounting portion 96 so as to hold the elongated supporting portion 97 and the mounting portion 96. The connecting members 100*a* through 100*e* have different lengths. Lengths L100*a*, L100*b*, L100*c*, L100*d* and L100*e* of the connecting members 100*a* through 100*e* satisfy the relationships: L100*c*<L100*b*<L100*a* and L100*c*<L100*d*<L100*e*. In other words, the distance from the rotation axis X to the mounting portion is the shortest at the substantially longitudinal center portion and is the longest at either longitudinal end portion. With such a structure, the mounting portion 96 is supported so as to have the arcuate shape.

The flexible member 92 is composed of an elongated rectangular flexible material having a width wider than the width of the mounting portion 96 of the rotation member 91, and is curved in the sword shape along the mounting portion 96. To be more specific, the flexible member 92 is composed of PET (Polyethylene terephthalate) having a thickness in a range from 50 μm to 200 μm. The flexible member 92 has thermal caulking holes 99*a*, 99*b*, 99*c*, 99*d* and 99*e* respectively engaging the thermal caulking pins 98*a* through 98*e* of the mounting portion 96. With such a structure, the flexible member 92 is fixed to the mounting portion 96 at one longer side of the rectangular flexible member 92.

The other longer side of the rectangular flexible member 92 faces the above described longer side fixed to the mounting portion 96, and forms a sliding end portion 102. When the agitation member 90 rotates, the sliding end portion 102 of the flexible member 92 slides along an inner surface 40-1 of the toner storing main body 40 to agitate the fresh toner T and convey the fresh toner T toward the substantially longitudinal center portion of the toner storing main body 40 in a sweeping manner.

Further, the flexible member 92 has a plurality of (in this example, seven) cuts 101 extending from the vicinity of the longer side fixed to the mounting portion toward the sliding end portion 92 of the flexible member 92. The cuts 101 divide the flexible member 92 into a plurality of (in this example, eight) flexible pieces 92-1 through 92-8 in the longitudinal direction. Since the flexible member 92 is divided into the flexible pieces 92-1 through 92-8, the agitation and conveying of the fresh toner T can be smoothly performed.

In this regard, the mounting portion 96 is supported by a plurality of connecting members 100*a* through 100*e* having different lengths. Therefore, the mounting surface of the mounting portion 96 is curved in the arcuate shape so that a distance from the rotation axis X to the mounting surface increases from the substantially longitudinal center portion toward either longitudinal end portion. This means that the flexible member 92 is also curved in the arcuate shape along the mounting portion 96. In contrast, the saw-toothed end portion 106 of the mounting portion 96 is curved in a sword shape as seen in front view of FIG. 21. The sliding end portion 102 of the flexible member 92 is smoothly curved in a sword manner so that a distance from the rotation axis X increases toward the substantially longitudinal center portion. Based on this relationship, the distance from the rotation axis X to the sliding end portion 102 of the flexible member 92 is substantially constant throughout the entire length of the flexible member 92.

Additionally, in the third embodiment, the mounting portion 96 has the saw-toothed end portion 106 facing the sliding end portion 102. The saw-toothed end portion 106 includes a plurality of (in this example, eight) saw-toothed end sections 106-1 through 106-8 corresponding to the flexible pieces 92-1 through 92-8. The saw-toothed end sections (i.e., saw teeth) 106-1 through 106-8 are shaped in a bilaterally symmetrical manner with respect to the substantially longitudinal center portion. Each of the saw-toothed end sections (for example, the saw-toothed end section 106-1) has an inclination such that a distance from the rotation axis X thereto increases from a side closer to the substantially longitudinal center portion of the mounting portion 96 toward the other side closer to either longitudinal end portion of the mounting portion 96. To be more specific, a width 106-1*a* of the saw-toothed end section 106-1 at a side (right side in FIG. 20) closer to the longitudinal end portion of the mounting portion 96 is wider than a width 106-1*b* of the saw-toothed end section 106-1 at the other side (left side in FIG. 20) closer to the substantially longitudinal center portion of the mounting portion 96.

Since the mounting portion 96 is formed as described above, the distances from the sliding end portions 102 of the respective flexible pieces 92-1 through 92-8 to the saw-toothed end section 106-1 through 106-8 are as shown in FIG. 21. For example, a distance 104*b* from the sliding end portion 102 of the flexible piece 92-1 to the saw-toothed end section 106-1 at the side (left side in FIG. 21) closer to the substantially longitudinal center portion of the mounting portion 96 is longer than a distance 104*a* from the sliding end portion 102 of the flexible piece 92-1 to the saw-toothed end section 106-1 at the other side (right side in FIG. 21) closer to the longitudinal end portion of the mounting portion 96. Similarly, a distance 104*b* from the sliding end portion 102 of the flexible piece 92-7 to the saw-toothed end section 106-7 at the side (right side in FIG. 21) closer to the substantially longitudinal center portion of the mounting portion 96 is longer than a distance 104*a* from the sliding end portion 102 of the flexible piece 92-7 to the saw-toothed end section 106-7 at the other side (left side in FIG. 21) closer to the longitudinal end portion of the mounting portion 96.

Figure 23:
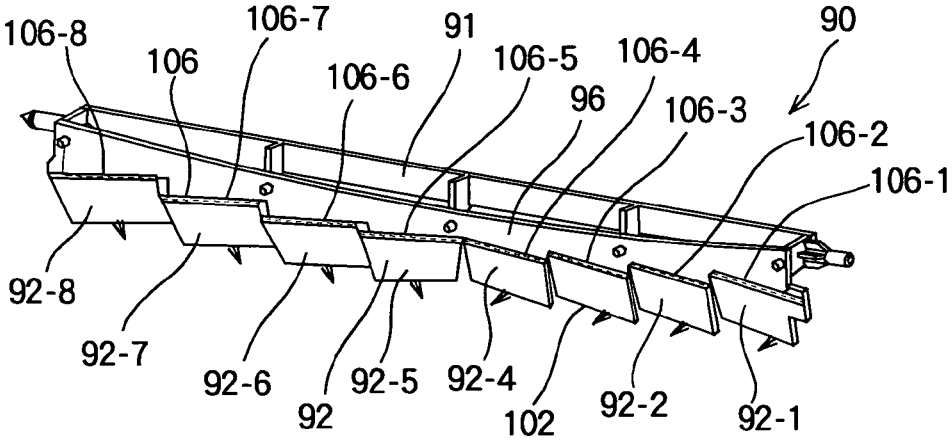
FIG. 23 is a schematic view showing an operation of the agitation member according to the third embodiment.

FIG. 23 is a schematic view showing an operation of the agitation member 90 according to the third embodiment. The sliding end portions 102 of the flexible pieces 92-1 through 92-8 of the flexible member 92 contact the inner surface 40-1 of the toner storing main body 40, and are deflected along the saw-toothed end sections 106-1 through 106-8 of the mounting portion 106. Therefore, the sliding end portions 102 of the flexible pieces 92-1 through 92-8 are inclined toward the substantially longitudinal center portion, so as to convey the fresh toner T toward the substantially longitudinal center portion of the agitation member 90 in a sweeping manner.

As described above, according to the third embodiment of the present invention, the agitation member 90 has the mounting portion 96 having the arcuate shape to which the flexible member 92 is mounted so as to have the arcuate shape. Further, in a state where the flexible member 92 is mounted to the mounting portion 96, the sliding end portion 102 of the flexible member 92 is curved so that a distance from the rotation axis X to the sliding end portion 102 increases from either longitudinal end toward the substantially longitudinal center portion. Furthermore, the flexible member 92 is divided by the cuts 101 into the flexible pieces 92-1 through 92-8 in the longitudinal direction, and the mounting portion 96 has the saw-toothed end sections 106-1 through 106-8 corresponding to the flexible pieces 92-1 through 92-8. With such a configuration, the sliding end portions 102 at both longitudinal end portions of the flexible member 92 slide along the inner surface 40-1 of the toner storing main body 40, ahead of the sliding end portion 102 at the substantially longitudinal center portion of the flexible member 92. Further, in this state, the sliding end portions 102 at both longitudinal end portions of the flexible member 92 are inclined at larger angles with respect to the direction perpendicular to the sliding direction than the sliding end portion 102 at the substantially longitudinal center portion of the flexible member 92. Further, in this state, the sliding end portions 102 of the flexible pieces 92-1 through 92-8 are inclined toward the substantially longitudinal center portion. Further, the agitation member 90 has the flexible member 92 at the tip thereof, and therefore, even when the toner cartridge 4 has a substantially square cross section, the agitation member 90 can even convey the fresh toner T located at corners of the toner storing portion 43 of the toner cartridge 4 using the sliding end portions 102 of the flexible member 92 in a sweeping manner. Accordingly, it becomes possible to reduce the amount of the unusable toner remaining in the toner cartridge 4 throughout the entire length of the toner cartridge 4. Further, the flexible member 92 can be smoothly moved, and it is ensured that the fresh toner existing in both longitudinal ends of the toner storing portion 43 can be conveyed to the substantially longitudinal center portion. As a result, it becomes possible to obtain an environmentally friendly developer storing container capable of providing sufficient amount of toner for printing as desired and reducing the amount of unusable toner.

In the first to third embodiments, a printer has been described as an example of the image forming apparatus. However, the present invention is also applicable to other image forming apparatus such as, for example, a copier, a facsimile machine, a MFP (Multiple-Function Peripheral) or the like.

Further, for example, in the respective embodiments, the rotation member of the agitation member includes the mounting portion having the arcuate shape for mounting the flexible member, the elongated supporting portion and the connecting members connecting the mounting portion and the elongated supporting portion. However, the rotation member of the agitation member can have an integral structure.

While the preferred embodiments of the present invention have been illustrated in detail, it should be apparent that modifications and improvements may be made to the invention without departing from the spirit and scope of the invention as described in the following claims.

What is claimed is:

1. A developer storing container comprising:

a developer storing portion with an elongated shape for storing a developer, said developer storing portion having a developer outlet opening at a substantially longitudinal center portion of said developer storing portion; and an agitation member that rotates about a rotation axis to agitate said developer in said developer storing portion so as to eject said developer via said developer outlet opening, said agitation member including a supporting member that rotates about said rotation axis and that includes longitudinal ends and a center, a mounting portion with a mounting surface along said rotation axis, a plurality of connecting members connecting the supporting member and the mounting portion so as to form a plurality of inner spaces therebetween, a plurality of the inner spaces being formed at the longitudinal ends of the supporting member and one of the inner spaces being formed at the center of the supporting member, each of the inner spaces formed at the longitudinal ends being larger than the one inner space formed at the center of the supporting member, a plurality of the connecting members being disposed at the longitudinal ends of the supporting member and one of the connecting members being disposed at the center of the supporting member, and each of the connecting members disposed at the longitudinal ends having a length that is longer than a length of the one connecting member disposed at the center of the supporting member, a flexible member having an elongated shape and having first and second ends facing each other, said flexible member being mounted to said mounting portion at said first end so that said second end defines a sliding end portion at which said flexible member slides along an inner surface of said developer storing portion in a sliding direction, longitudinal end portions of said sliding end portion sliding along said inner surface of said developer storing portion, ahead of a substantially longitudinal center portion of said sliding end portion in said sliding direction, and being inclined with respect to a direction perpendicular to said sliding direction.

2. The developer storing container according to claim 1, wherein said mounting surface of said mounting portion has an elongated and arcuate shape, and is shaped so that a distance from said rotation axis to said mounting surface increases from a substantially longitudinal center portion of said mounting portion toward a longitudinal end portion of said mounting portion.

3. The developer storing container according to claim 1, wherein a longer side of said mounting surface of said mounting portion, that is longer than another side of said mounting surface, is curved so that a distance from said rotation axis to said longer side increases from a longitudinal end portion of said mounting portion toward a substantially longitudinal center portion of said mounting portion, and wherein said flexible member is mounted to said mounting portion in a curved manner.

4. The developer storing container according to claim 3, wherein a distance from said rotation axis to said second end of said flexible member is substantially the same throughout an entire length of said flexible member.

5. The developer storing container according to claim 1, wherein a longer side of said mounting surface of said mounting portion, that is longer than another side of said mounting surface, is curved so that a distance from said rotation axis to said longer side increases from a longitudinal end portion of said mounting portion toward a substantially longitudinal center portion of said mounting portion, and said longer side of said mounting surface of said mounting portion is saw-toothed, and wherein said flexible member is divided into a plurality of sections in a longitudinal direction of said flexible member which are provided along said mounting portion.

6. The developer storing container according to claim 5, wherein said longer side of said mounting surface of said mounting portion which is saw-toothed includes a plurality of saw teeth corresponding to said flexible member divided into a plurality of sections.

7. The developer storing container according to claim 6, wherein said saw teeth of said mounting portion are inclined toward the substantially longitudinal center portion of said mounting portion, and are symmetrical with respect to said substantially longitudinal center portion of said mounting portion.

8. A developing device comprising said developer storing container according to claim 1.

9. The developing device according to claim 8, wherein said developer storing container is detachably mounted to a main body of said developing device.

10. An image forming apparatus comprising said developing device according to claim 8.

11. An image forming apparatus comprising said developer storing container according to claim 1.

12. The developer storing container according to claim 1, wherein each of the lengths of the connecting members disposed at the longitudinal ends of the supporting member and the one connecting member are measured along a direction perpendicular to a surface of the supporting member that the connecting members disposed at the longitudinal ends of the supporting member and the one connecting member touch.

13. The developer storing container according to claim 12, wherein each of the inner spaces that are formed at the longitudinal ends of the supporting member have a length, measured along the direction perpendicular to the surface of the supporting member, that is longer than a length, measured along the direction perpendicular to the surface of the supporting member, of the one inner space formed at the center of the supporting member.

* * * * *